United States Patent [19]

Ishii

[11] 4,062,392

[45] Dec. 13, 1977

[54] DOUBLE HANDLED BAG - FOLDABLE TO TWO SIZES

[75] Inventor: Kitae Ishii, Tokyo, Japan

[73] Assignee: Merril Hermanson, New York, N.Y.

[21] Appl. No.: 787,652

[22] Filed: Apr. 14, 1977

[51] Int. Cl.[2] ..... A45C 3/04

[52] U.S. Cl. ..... 150/1.7; 229/54 R

[58] Field of Search ..... 150/1.7, 12; 229/54 R, 229/54 C; 224/45 R, 45 P, 45 D

[56] References Cited

U.S. PATENT DOCUMENTS

| | | | |
|---|---|---|---|
| 616,249 | 12/1898 | Nickerson | 150/12 |
| 2,047,095 | 7/1936 | Booth | 150/1.7 |
| 3,229,741 | 1/1966 | Ambrose | 150/1.7 |

*Primary Examiner*—Donald F. Norton
*Attorney, Agent, or Firm*—Karl W. Flocks

[57] ABSTRACT

An improved bag construction comprising a bag formed from a single piece of material in sleeve form, having a single generally vertically extending seam securing generally vertically extending abutting edges of the bag, a closed bottom section with horizontal edges stitched together and gusset members formed on opposite ends of the bottom section by stitching extending transversely to the stitches of the horizontal edges. The bag being inverted so that all seams appear in the interior thereof. The bag also comprising a handle assembly formed from a single piece strap with superimposed ends stitched to each other to provide an endless elongate closed loop having a pair of spaced apart loop ends, which constitute a first set of handles for the bag, and a second set of handles of inverted U-shape configuration with downwardly directed ends adhered to the closed loop intermediate the loop ends thereof. The handle assembly extending with the generally parallel strips along two opposite exterior sides of the bag, around the bottom thereof and being stitched to the bag and the loop ends projecting above the top of the bag the second set of handles extending intermediate the top and the bottom of the bag.

9 Claims, 10 Drawing Figures

FIG. 7.
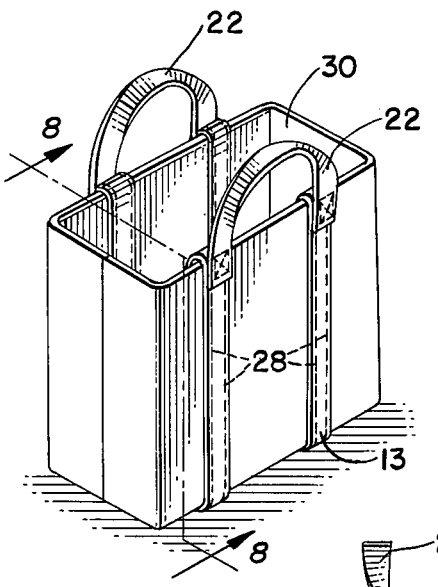
FIG. 5.
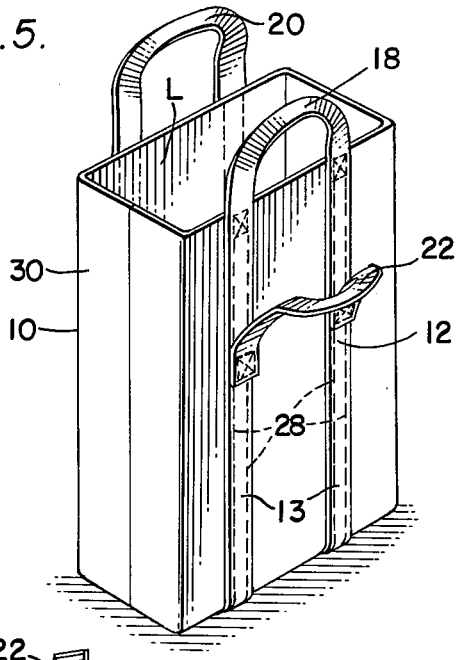
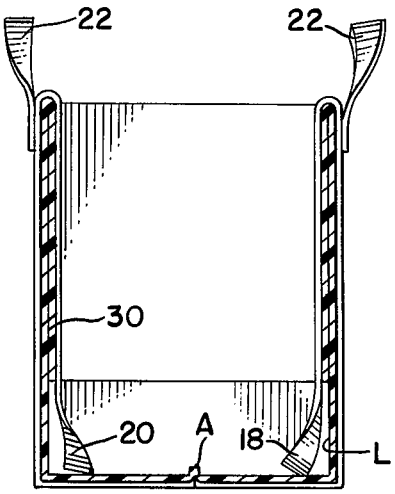
FIG. 8.
FIG. 1.
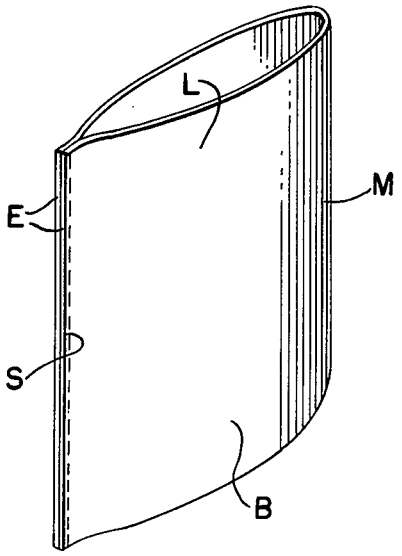
FIG. 2.
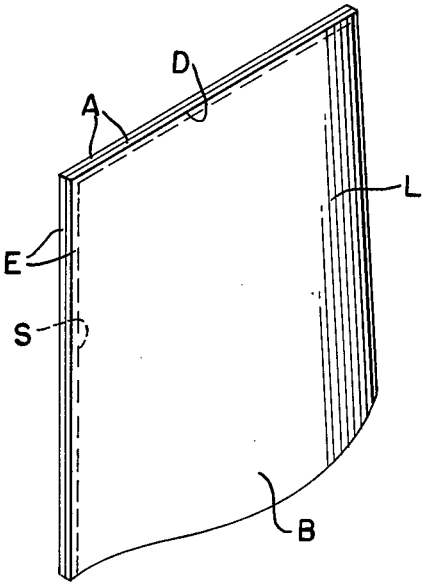

DOUBLE HANDLED BAG - FOLDABLE TO TWO SIZES

BACKGROUND OF THE INVENTION

The present invention relates to a bag construction and more particularly to a general purposed container shopping bag that is reusable over numerous occasions.

Bags of the type to which the present invention appertains are generally made of paper and are limited in strength and times of repeated usage before they are discarded. Shopping bags of fabric material are known in the prior art, but they subject the user to a somewhat uncomely appearance, especially when they are carried about without contents therein.

SUMMARY OF THE INVENTION

The bag according to the present invention has been developed to stand up against weather conditions, load conditions and the usual wear-and-tear to which shopping bags are normally subjected and be available for repeated usage over a significantly greater number of times than ordinary shopping bags. The present invention resides in an improved bag and handle construction with which relatively heavy loads may be carried without undue deterioration to the bag.

It is also an object of the present invention to provide a bag and handle construction which is readily adapted to carry a relatively small volume heavy load or a relatively larger volume heavy load.

It is further an object to provide a bag and handle construction whereby upper portions of the bag may be turned inwardly to effectively convert into a relatively smaller size bag or alternatively at the user's option the bag may be extended to its full size to accomodate a relatively larger size load.

It is yet another object of the present invention to provide a shopping bag of such construction that it will be readily folded into compact size and be neatly stored or carried in a pouch without subjecting its owner to an uncomely appearance.

Other objects and advantages of the present invention will become apparent to the reader in the detailed description appearing below and in the accompanying drawings.

BRIEF DESCRIPTION OF THE DRAWINGS

A preferred embodiment of the present invention is described below with reference being made to the accompanying drawings, wherein:

FIGS. 1, 2 and 3 show in perspective the progressive formation of the bag structure of the present invention from a blank or web of material;

FIG. 5 is a view in perspective of the bag of FIG. 4 after the handle assembly has been attached thereon;

FIG. 7 is a view in perspective of the bag of FIG. 5 with upper portions inserted into the interior whereby the bag is adapted to accommodate a relatively small volume of packages or the like;

FIG. 8 is a view taken along section 8—8 in FIG. 7;

DETAILED DESCRIPTION OF THE INVENTION

Figure 3:
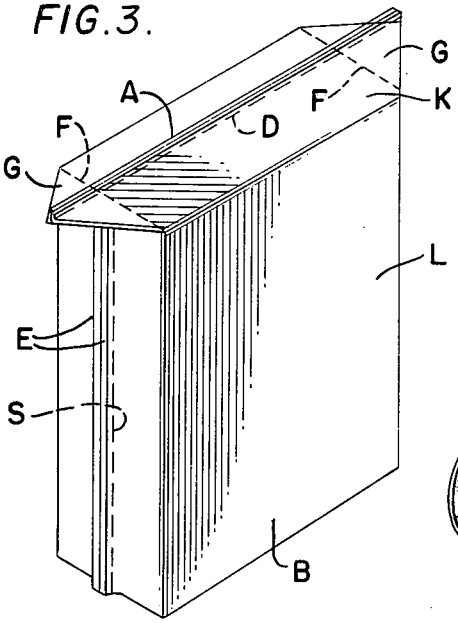
Figure 4:
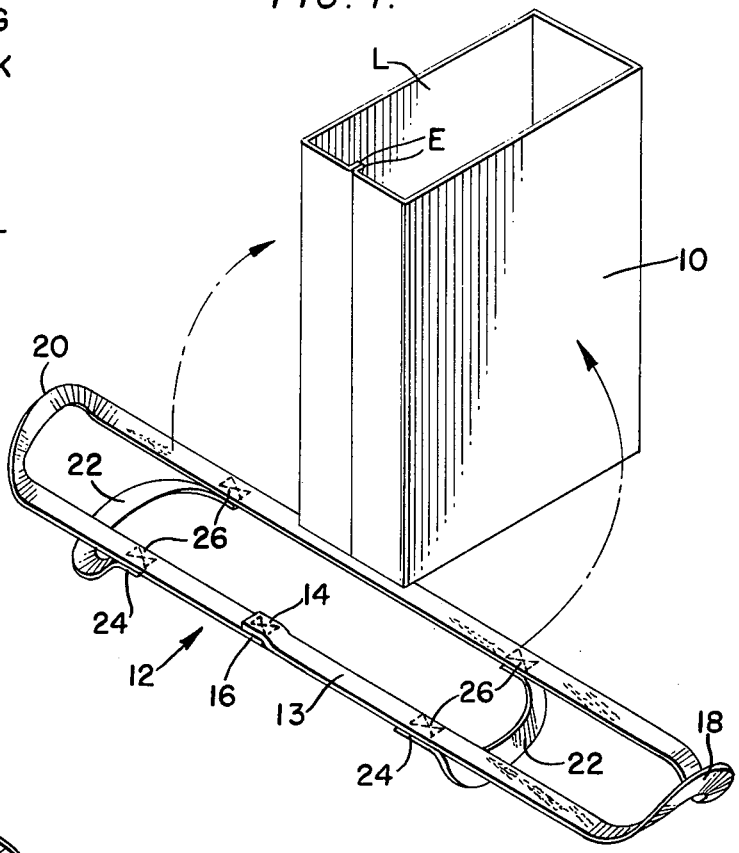
FIG. 4 shows in perspective the bag formation of FIG. 3 inverted into final form and a handle assembly extending beneath the bag prior to attachment thereon.

Referring in detail to FIGS. 1-5 the reader will readily appreciate the development of a preferred embodiment of the present invention which comprises a bag 10 and handle assembly 12 attached thereto. The bag 10 is formed from a single piece, generally rectangular web or blank B of material by folding opposite edges E together 180° about midsection M. Edges E are secured together to form a seam by stapling or stitches S to provide a sleeve or tube form, as shown in FIG. 1. Extending from opposite sides of one end of midsection M two portions of an edge A, which portions are secured together to form a seam by staping or stitches D, as seen in FIG. 2, to close up one end of the bag 10. The sidewall portion L and closed end K of the bag 10 are then squared off with the formation of triangular gussets G, which are permanently formed by staples, stitches F or the like. The bag of FIG. 3 as thus formed is then inverted to the condition as seen in FIG. 4 in which the edges E and sidewall portions L appear on the interior of the bag 10 along with edge A and stitches S, D, F and gussets G, and all seams, all of which are now disposed within the bag 10. Also hidden from view in FIG. 4 is the closed end K which is now inside the bag 10 and forms the bottom thereof.

As seen in FIG. 4 a handle assembly 12 is formed from a single piece strap 13 into an endless elongate closed loop having a pair of generally parallel strips terminating in a pair of spaced apart loop ends which constitute a first or principal set of handles 18, 20. A secondary or auxiliary set of handles 22 of inverted U-shape configuration with downwardly directed ends 24 is adhered with stitches 26 to the closed loop strap 13 intermediate the loop ends or handles 18, 20 thereof. The strap 13 is formed into an endless loop by superimposing ends 14, 16 thereof onto each other and securing same together, for example, by stitching. Bag 10 and handle assembly 12 are assembled together by locating the bottom of bag 10 over generally parallel portions of strap 13 extending intermediate of auxiliary handles 22 and placing parallel portions of strap on opposite sides of the bottom of the bag 10 against opposite sides of the bag adjacent thereto and thereafter securing the strap 13 to surfaces of the bag 10 adjacent thereto or in contact therewith as by stitching at 28 as may be seen in FIGS. 5-7.

Figure 6:
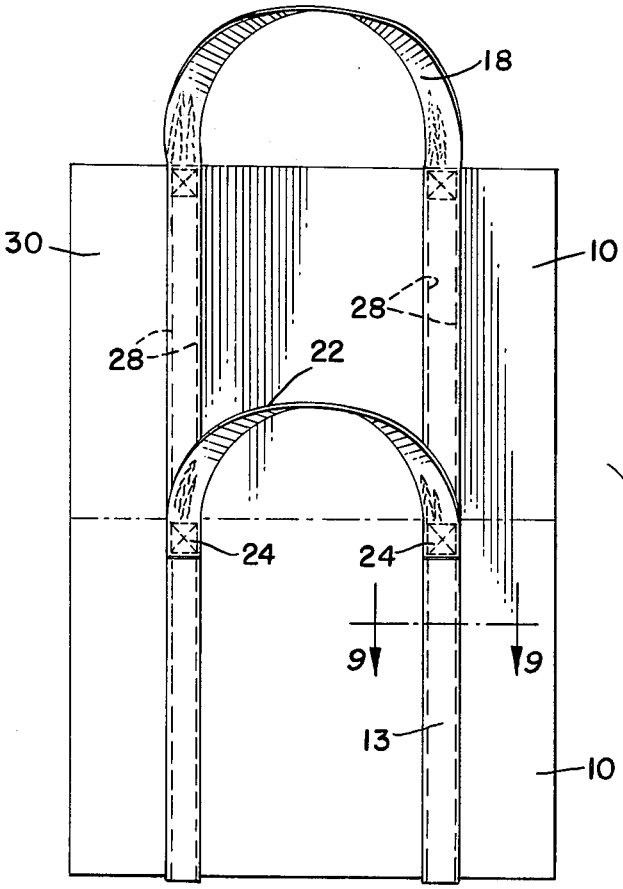
FIG. 6 is a front elevational view of the bag of FIG. 5.

From the foregoing it may be readily appreciated that in the fully extended condition of the bag 10, as may be envisioned in FIGS. 5 and 6, a relatively large volume load is carried by grasping principal handles 18, 20. In the foregoing situation auxiliary handles 22 are now in use and the load within bag is supported by portions of strap 13 extending around the bottom of bag 10 in cradling relationship therewith.

When a relatively small volume load is to be carried the upper portion 30 of bag 10, above the area where auxiliary handles 22 are secured to strap 13 and to the bag 10, is folded inwardly and inserted into the interior of bag 10 along with principal handles 18, 20 as illustrated in FIGS. 7 and 8. With the conversion of bag 10 to accommodate a relatively small volume load as illustrated in FIGS. 7 and 8, the load to be carried thereby need not be carried in dangling fashion nor down to the ground or at one's feet particularly by a person of short stature.

Figure 9:
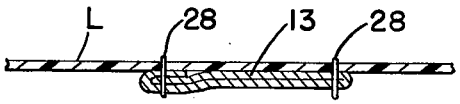
FIG. 9 is a view taken along section 9—9 in FIG. 6.

The handle assembly 12 as may be appreicated from FIG. 9 comprises in cross section a single web of fabric with at least two folds or three layers and so placed against the outer surface of bag 10 that no raw edges will be exposed to view. While in FIG. 9 edges of the folds are secured in lapped relationship, they may also be secured in butting relationship. With the handle assembly 12 being formed from folds of material as disclosed, it is clear that a strengthened carrying handle is provided. Further, with portions of the handle assembly 12 extending in cradling relationship around the bottom of bag 10, greater loads may be carried with assurance. Also with auxiliary handles 22 attached to multilayer strap 13 and also to the bag 10, relatively heavy loads may be carried thereby with assurance.

Figure 10:
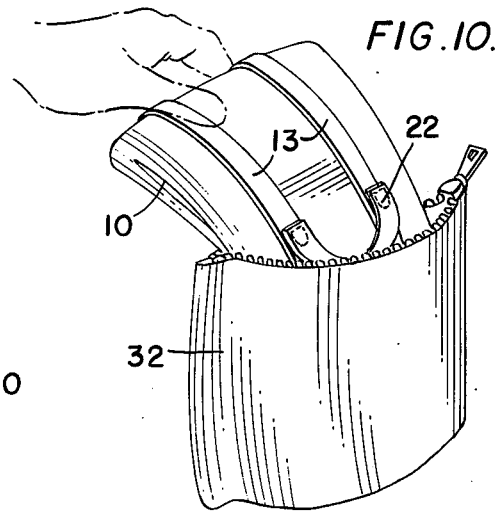
FIG. 10 shows the bag of FIG. 5 folded into compact form and being inserted into or removed from a storage pouch.

Bag 10 and handle assembly 12 are, according to the present invention, formed from a high strength, light weight material whereby the bag may be reused time and again to handle relatively heavy loads without need of replacement. Moreover, because bag 10 and handle assembly 12 are of light weight material, it may be readily folded into neat and compact size for storage. Within the concept of the present invention the bag 10 and handle assembly may be folded into compact condition and inserted into a storage pouch 32 as indicated in FIG. 10. When stored in pouch 32, one may conveniently carry bag 10 and the handle assembly 12 in one's pocket or in a purse until use thereof is desired.

Within the concept of the present invention the material from which bag 10 and handle assembly 12 are to be formed is to be a relatively high strength, light weight material, which may, for example, be a synthetic plastic such as polyamide nylon or like materials.

It is understood that the invention is not limited to the embodiments disclosed above which are illustratively offered, and that modifications may be made without departing from the scope of the invention.

What is claimed is:

1. An improved bag and handle construction comprising:

a. a bag formed from a single piece of material in sleeve form, having a single generally vertically extending seam securing generally vertically extending abutting edges of said bag, a closed bottom section with horizontal edges stitched together and gusset members formed on opposite ends of the bottom section by stitching extending transversely to the stitches of the horizontal edges, said bag being inverted so that all seams appear in the interior thereof; and b. a handle assembly formed from a single piece strap with superimposed ends stitched to each other to provide an endless elongate closed loop having a pair of generally parallel strips terminating in a pair of spaced apart loop ends, said loop ends constituting a first set of handles for said bag, and a second set of handles of inverted U-shape configuration with downwardly directed ends adhered to said closed loop intermediate the loop ends thereof;

c. said handle assembly extending with said generally parallel strips along two opposite exterior sides of said bag, around the bottom thereof and being stitched to said bag and said loop ends projecting above the top of said bag, said second set of handles extending intermediate the top and the bottom of said bag;

d. said bag including an upper portion above said second set of handles being foldable into the interior of said bag whereby said second set of handles will become functionable.

2. The bag and handle construction of claim 1 wherein said single piece strap forming part of said handle assembly comprises a folded web of material including at least two 180° folds with a free edge of one fold sandwiched between two folded layers of material.

3. The bag and handle construction of claim 2 wherein a second free edge of said folded web of material is adjacent the outer surface of said bag so that no raw edge is exposed to view and with stitches extending thereat through at least three layers of said folded web of material and said bag.

4. The bag and handle construction according to claim 3 wherein said folded web of material is also stitched to said bag through a single fold of two layers thereof.

5. The bag and handle construction of claim 4 wherein said bag and handle assembly is formed from light weight, high strength fabric.

6. The bag and handle construction of claim 5 wherein said light weight, high strength fabric is a synthetic plastic material.

7. The bag and handle construction of claim 5 wherein said light weight, high strength material is a polyamide fabric.

8. The bag and handle construction of claim 7 wherein said bag and handle are of such light weight material that said bag and handle construction is readily foldable to about wallet size and readily stored.

9. The bag and handle construction of claim 8 in combination with a storage pouch wherein said bag and handle construction is neatly folded in about wallet size and snugly disposed inside said storage pouch.

* * * * *